US009404307B2

(12) United States Patent
Maidla

(10) Patent No.: US 9,404,307 B2
(45) Date of Patent: Aug. 2, 2016

(54) METHOD AND SYSTEM FOR DIRECTIONAL DRILLING

(71) Applicant: Schlumberger Technology Corporation, Sugar Land, TX (US)

(72) Inventor: Eric E. Maidla, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 134 days.

(21) Appl. No.: 14/293,935

(22) Filed: Jun. 2, 2014

(65) Prior Publication Data

US 2015/0345223 A1 Dec. 3, 2015

(51) Int. Cl.

| | |
|---|---|
| ***E21B 7/06*** | (2006.01) |
| ***E21B 7/04*** | (2006.01) |
| ***E21B 44/04*** | (2006.01) |
| ***E21B 47/12*** | (2012.01) |
| ***E21B 47/00*** | (2012.01) |

(52) U.S. Cl.

CPC . *E21B 7/068* (2013.01); *E21B 7/04* (2013.01); *E21B 44/04* (2013.01); *E21B 47/0006* (2013.01); *E21B 47/12* (2013.01)

(58) Field of Classification Search

CPC ..... E21B 7/04; E21B 44/04; E21B 47/12; E21B 47/024

See application file for complete search history.

(56) References Cited

U.S. PATENT DOCUMENTS

| | | | | |
|---|---|---|---|---|
| 6,192,748 | B1 | 2/2001 | Miller | |
| 6,802,378 | B2 | 10/2004 | Haci et al. | |
| 6,918,453 | B2 | 7/2005 | Haci et al. | |
| 7,096,979 | B2 | 8/2006 | Haci et al. | |
| 7,556,105 | B2 * | 7/2009 | Krueger | E21B 7/062 175/325.1 |
| 7,810,584 | B2 | 10/2010 | Haci et al. | |
| 9,103,195 | B2 * | 8/2015 | Gawski | E21B 7/04 |
| 2006/0021797 | A1 * | 2/2006 | Krueger | E21B 7/062 175/61 |
| 2008/0066958 | A1 * | 3/2008 | Haci | E21B 44/00 175/27 |
| 2010/0108383 | A1 | 5/2010 | Hay et al. | |
| 2011/0024187 | A1 | 2/2011 | Boone et al. | |
| 2013/0032407 | A1 | 2/2013 | Edbury et al. | |

OTHER PUBLICATIONS

International Search Report for corresponding International App No. PCT/US2015/033467, Oct. 1, 2015, 4 pages.

Written Opinion for corresponding International App No. PCT/US2015/033467, Sep. 1, 2015, 9 pages.

* cited by examiner

*Primary Examiner* — Shane Bomar

(57) ABSTRACT

A method and system for directionally drilling a wellbore. The method includes measuring an off-bottom rotating torque applied to a drill string in the wellbore. A steerable drilling motor is oriented proximate a bottom of the drill string in a selected direction, and a surface rotational orientation of the drill string is measured. Torque is applied to the drill string at the surface to maintain the surface rotational orientation. The applied torque is automatically increased and decreased by a selected amount related to the measured off-bottom rotating torque.

16 Claims, 2 Drawing Sheets

METHOD AND SYSTEM FOR DIRECTIONAL DRILLING

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND

This disclosure is related to the field of directional drilling wellbores through subsurface formations. More specifically, the disclosure relates to methods and systems for drilling such wellbores along a selected trajectory using "steerable" hydraulically powered drilling motors.

U.S. Pat. No. 7,810,584 issued to Haci et al. describes a method and system for automatically operating a drilling system using a "steerable" hydraulically powered drilling motor disposed within a drill pipe "string" in conjunction with rotation of the drill pipe string from the surface. Rotation from the surface may be performed using, for example, a top drive or a kelly/rotary table. The drilling motor may have a housing with a slight bend in its shape, such that when the drilling motor alone is used to rotate a drill bit at the lower end portion of the drill pipe string, and the drilling motor is held in a selected rotational orientation, the trajectory of the wellbore tends to move in a direction of the interior of the bend in the housing. When the entire drill pipe string is rotated, the wellbore trajectory tends to continue in a substantially straight line. Thus, during directional drilling operations, a system operator may change or maintain the wellbore trajectory by stopping drill pipe string rotation, orienting the drilling motor in a selected direction and continuing drilling by using just the drilling motor to rotate the drill bit.

Systems and methods disclosed in the Haci et al. '584 patent may be used to increase drilling efficiency during such periods of time when the drill pipe string is not rotated (called "slide drilling"). In the most general terms, such systems and methods automatically rotate the drill string back and forth between selected surface-measured torque values, such that axial friction between the drill pipe string and the wall of the wellbore is reduced, while not causing substantial change in the orientation (called "toolface angle" or simply "toolface") of the drilling motor.

The systems and method described in the Haci et al. '584 patent, as well as U.S. Pat. Nos. 7,096,979, 6,918,453 and 6,802,378, have been shown to provide improvement in drilling efficiency when a wellbore is drilled such that there is substantial lateral displacement of the well trajectory from its surface location (i.e., the starting point of the well).

Many wellbores drilled to have such lateral displacement may also have a portion thereof which is substantially vertical. At a selected depth in the wellbore, directional drilling may be initiated by stopping rotation of the drill pipe string such that the drilling motor is oriented in a selected direction and commencing slide drilling. During such initial part of directional drilling, there is relatively low friction between the wellbore wall and the drill pipe string. Under such conditions, the toolface orientation may be maintained by applying a torque to the drill pipe string at the surface using a rotary table or top drive as described above. Such surface applied torque is needed to offset reactive torque generated by the drilling motor when the drill pipe string is allowed to move into the wellbore so that the drill bit at the end portion thereof drills the subsurface formations.

SUMMARY

A method for directionally drilling a wellbore is disclosed. At a selected point in the wellbore, the off-bottom rotating torque applied to a drill string in the wellbore may be measured. A steerable drilling motor may be oriented proximate a bottom of the drill string in a selected direction. A surface rotational orientation of the drill string may also be measured. Torque may be applied to the drill string at the surface to maintain the surface rotational orientation. The applied torque may be automatically increased and decreased by a selected amount with the selected amount being related to the measured off-bottom rotating torque.

A directional drilling system is disclosed. The directional drilling system may include a steerable drilling motor coupled to a drill string. A means for rotating the drill string at the surface may include a rotation controller. The directional drilling system may also include a torque sensor for measuring torque applied by the means for rotating, a rotational orientation sensor for determining rotary orientation of the drill string at the surface, and a directional sensor proximate the steerable drilling motor for measuring a toolface angle thereof. In one or more implementations, the directional drilling system includes a processor in signal communication with the rotation controller, the torque sensor, the rotational orientation sensor and the directional sensor. The processor may be programmed to operate the rotation controller to cause the means for rotating to apply a holding torque to maintain a drill string orientation measured at the surface while increasing and decreasing a torque applied to the drill string by a selected amount related to a measured off-bottom torque required to rotate the drill string.

The above referenced summary section is provided to introduce a selection of concepts in a simplified form that are further described below in the detailed description section. The summary is not intended to be used to limit the scope of the claimed subject matter. Furthermore, the claimed subject matter is not limited to implementations that solve disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate various implementations described herein and are not meant to limit the scope of various techniques disclosed herein.

DETAILED DESCRIPTION

Figure 1:
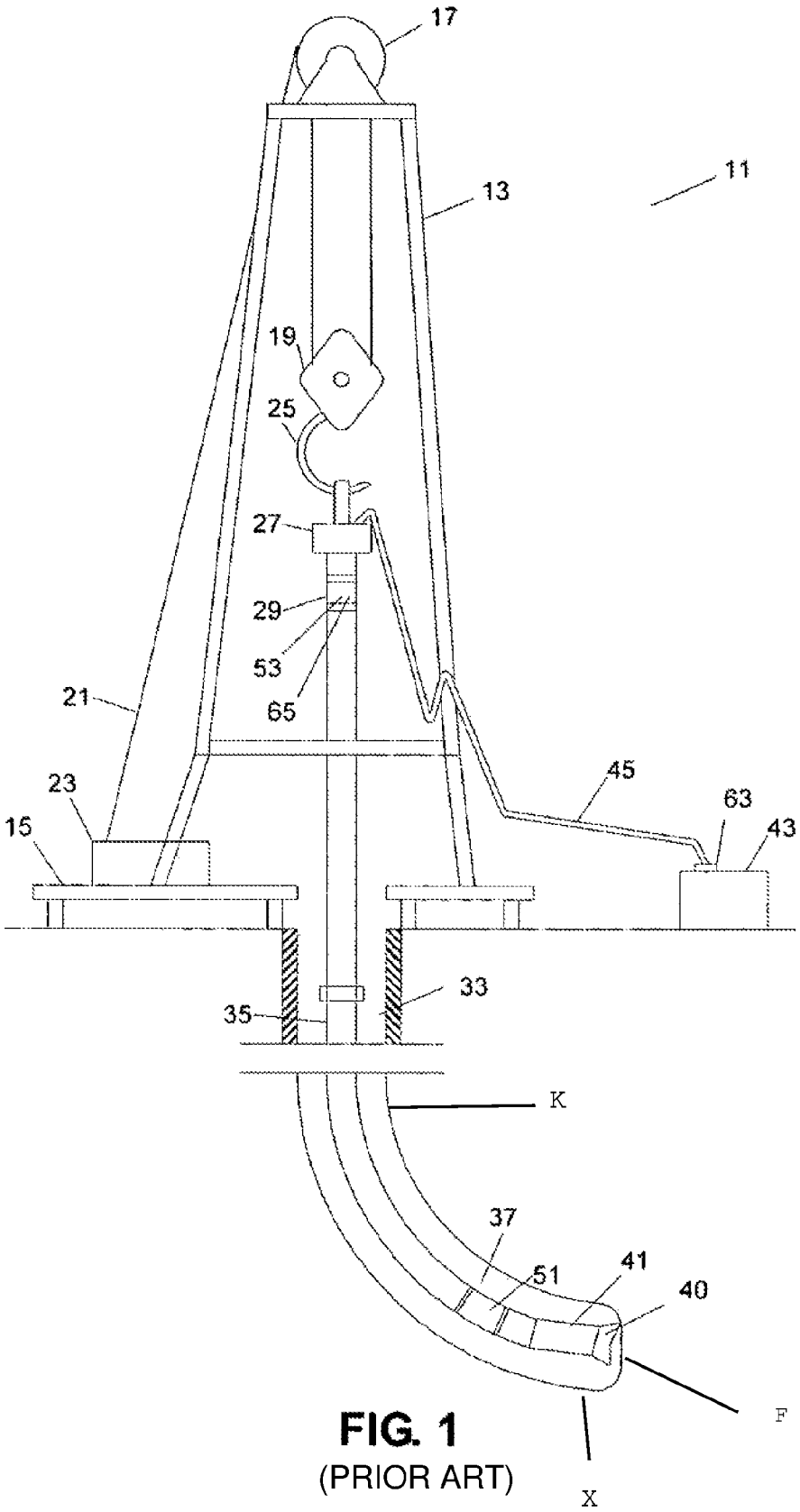
FIG. 1 (PRIOR ART)
FIG. 1 is a schematic view of a directional drilling system that may be used in accordance with the present disclosure.

FIG. 1 shows a schematic view of a directional drilling system according to various aspects of the disclosure. A drilling rig ("rig") is designated generally by reference numeral 11. The rig 11 shown in FIG. 1 is a land rig, but this is for illustration purposes only, and is not intended to be a limitation on the scope of the present disclosure. As will be apparent to those skilled in the art, methods and systems according the present disclosure would apply equally to water-borne rigs, including, but not limited to, jack-up rigs, semisubmersible rigs, and drill ships.

The rig 11 includes a derrick 13 that is supported on the ground above a rig floor 15. The rig 11 includes lifting gear, which includes a crown block 17 mounted to the derrick 13 and a traveling block 19. The crown block 17 and the traveling block 19 are interconnected by a cable 21 that is driven by a draw works 23 to control the upward and downward movement of the traveling block 19. The traveling block 19 carries a hook 25 from which a top drive 27 may be suspended. The top drive 27 rotatably supports a drill pipe string ("drill string"), designated generally by reference numeral 35, in a wellbore 33. The top drive 27 can be operated to rotate the drill string 35 in either direction, or to apply a selected amount of torque to the drill string 35.

According to one example implementation, the drill string 35 may be coupled to the top drive 27 through an instrumented top sub 29, although this is not a limitation on the scope of the present disclosure. A surface drill string torque sensor 53 may be provided in the instrumented top sub 29. However, the particular location of the surface torque sensor 53 is not a limitation on the scope of the present disclosure. A surface drill pipe rotational orientation sensor 65 that provides measurements of drill string angular position or "surface" tool face may also be provided in the instrumented top sub 29. However, the particular location of the surface drill pipe rotational orientation sensor 65 is not a limitation on the scope of the present disclosure. In one example implementation, the instrumented top sub 29 may be a device sold by 3PS, Inc., Cedar Park, Tex. known as an "Enhanced Torque and Tension Sub."

The surface torque sensor 53 may be implemented as a strain gage in the instrumented top sub 29. The torque sensor 53 may also be implemented as a current measurement device for an electric rotary table or top drive motor, or as a pressure sensor for a hydraulically operated top drive, as previously described. The drill string torque sensor 53 provides a signal which may be sampled electronically. The orientation sensor 65 may be implemented as an integrating angular accelerometer (and the same may be used to provide measurements related to surface torque). Irrespective of the instrumentation used, the torque sensor 53 provides a measurement corresponding to the torque applied to the drill string 35 at the surface by the top drive 27 or rotary table (not shown), depending on how the rig 11 is equipped. Other parameters which may be measured, and the corresponding sensors used to make the measurements, will be apparent to those skilled in the art and include, without limitation, fluid pressure in the drill string 35.

The drill string 35 may include a plurality of interconnected sections of drill pipe (not shown separately) and a bottom hole assembly ("BHA") 37. The bottom hole assembly 37 may include stabilizers, drill collars and a suite of measurement-while-drilling ("MWD") instruments, including a directional sensor 51. As will be described in greater detail below, the directional sensor 51 provides, among other measurements, tool face angle measurements, as well as wellbore geodetic or geomagnetic direction (azimuth) and inclination measurements.

A steerable drilling motor ("steerable motor") 41 may be connected near the bottom of the bottom hole assembly 37. The steerable motor 41 may be, but is not limited to, a positive displacement motor, a turbine, or an electric motor that can turn the drill bit 40 independently of the rotation of the drill string 35. As is well known to those skilled in the art, the tool face angle of the drilling motor is used to correct or adjust the azimuth and inclination of the wellbore 33 during slide drilling. Drilling fluid is delivered to the interior of the drill string 35 by mud pumps 43 through a mud hose 45. During rotary drilling, the drill string 35 is rotated within the wellbore 33 by the top drive 27. As is known to those skilled in the art, the top drive 27 is slidingly mounted on parallel vertically extending rails (not shown) to resist rotation as torque is applied to the drill string 35. During slide drilling, the drill string 35 may be held rotationally in place by the top drive 27 while the drill bit 40 is rotated by the steerable motor 41. The steerable motor 41 is ultimately supplied with drilling fluid by the mud pumps 43 through the mud hose 45 and through the drill string 35.

The rig operator ("driller") may operate the top drive 27 to change the tool face orientation of the steerable motor 41 by rotating the entire drill string 35. A top drive 27 for rotating the drill string 35 is illustrated in FIG. 1, but the top drive shown is for illustration purposes only, and is not intended to limit the scope of the present disclosure. Those skilled in the art will recognize that systems and methods according to the present disclosure may also be used in connection with other equipment used to turn the drill string at the earth's surface. One example of such other equipment is a rotary table and kelly bushing (neither shown) to apply torque to the drill string 35. The cuttings produced as the drill bit 40 drills into the subsurface formations are carried out of the wellbore 33 by the drilling fluid supplied by the mud pumps 43.

The discharge side of the mud pumps 43 may include a drill string pressure sensor 63. The drill string pressure sensor 63 may be in the form of a pump pressure transducer coupled to the mud hose 45 running from the mud pumps 43 to the top drive 27. The pressure sensor 63 makes measurements corresponding to the pressure inside the drill string 35. The actual location of the pressure sensor 63 is not intended to limit the scope of the present disclosure. Some implementations of the instrumented top sub 29, for example, may include a pressure sensor.

Figure 2:
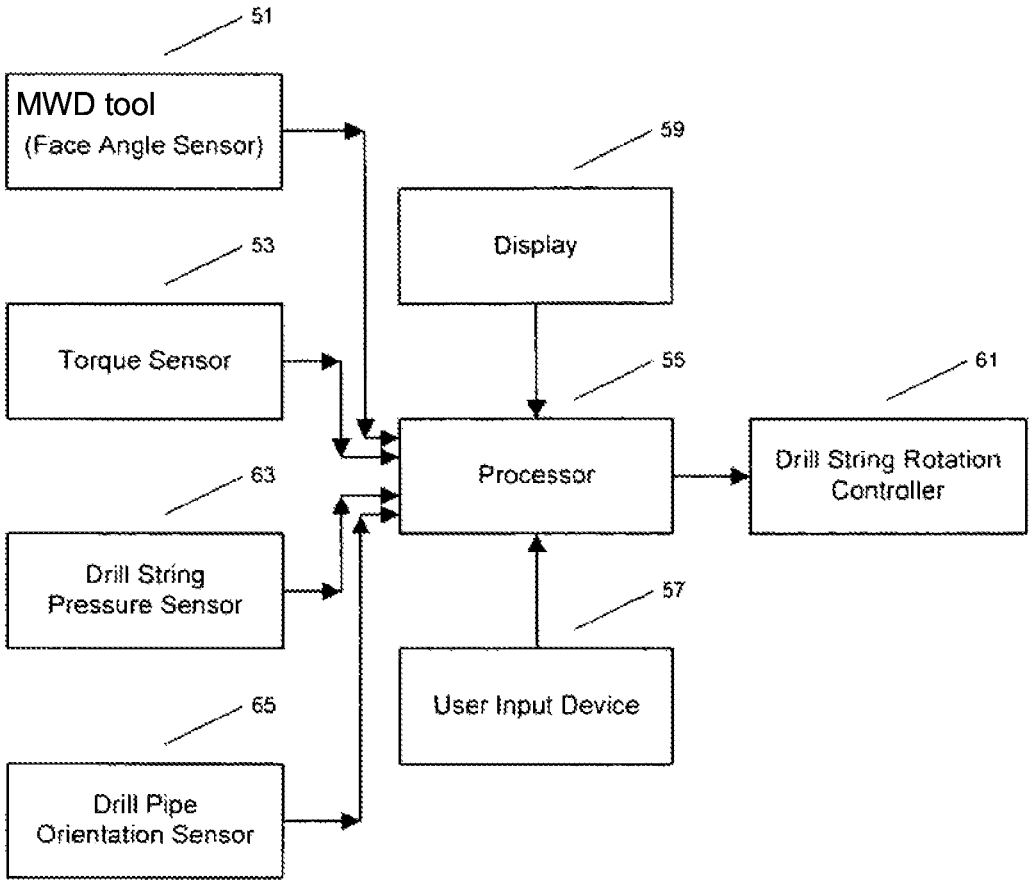
FIG. 2 (PRIOR ART)
FIG. 2 is a block diagram of an example directional drilling control system according to the present disclosure.

FIG. 2 shows a block diagram of a directional drilling control system according to an implementation of the present disclosure. The system may accept as input, signals from a steering tool or the directional sensor 51 (in an MWD system as described with reference to FIG. 1, for example) which produces a signal indicative of the tool face angle of the steerable motor 41. The system may accept as input a signal from the drill string torque sensor 53. The torque sensor 53 provides a measure of the torque applied to the drill string at the surface. The system may also accept as input a signal from the drill string pressure sensor 63 that provides measurements of the drill string pressure. The system may also accept as input signals from the surface drill pipe rotational orientation sensor 65. In FIG. 2 the outputs of the directional sensor 51, the torque sensor 53, the pressure sensor 63, and the drill pipe rotational orientation sensor 65 are received at or otherwise operatively coupled to a processor 55. The processor 55 may be programmed, according to process signals received from the above described sensors 51, 53, 63, and 65. The processor 55 may also receive user input from user input devices, indicated generally at 57. User input devices 57 may include, but are not limited to, a keyboard, a touch screen, a mouse, a light pen, or a keypad. The processor 55 may also provide visual output to a display 59. The processor 55 also provides output to a drill string rotation controller 61 that operates the top drive 27 (FIG. 1) or rotary table (not shown) to rotate the drill string 35 in a manner as will be further described below.

Referring again to FIG. 1, as the drilling of the wellbore 33 commences, the wellbore 33 may be substantially vertical. At a selected depth in the wellbore 33, called the "kickoff point" K, directional drilling along a selected trajectory may be initiated. Initiating directional drilling may be performed by having the driller operate the top drive 27 (or kelly/rotary table if such are used on a particular rig) to rotate the drill string 35 to a rotary orientation such that a selected toolface angle (as may be measured by sensor 51) of the steerable motor 41 is obtained. The drill string 35 may be lowered into the wellbore 33 such that some of the axial loading (weight) of the drill string 35 is transferred to the drill bit 40. When the drill bit 40 engages the subsurface formations and begins to drill them, the steerable motor 41 will exert torque on the drill bit 40. A reactive torque will be generated and applied to the drill string 35, the reactive torque being in a direction opposite to the torque generated by the drilling motor 41. The driller may operate the top drive 27 to apply torque in a direction opposite to the reactive torque such that the selected toolface angle is maintained. The orientation sensor 65 may generate a signal indicative of the drill string rotational orientation at the surface when such conditions are maintained. As will be appreciated by those skilled in the art, the actual rotational orientation of the drill string 35 as measured by the orientation sensor 65 may depend on, among other factors, the length of the drill string 35 and the torsional properties of the components of the drill string 35. Thus, the measured drill string orientation at the surface may differ from the measured toolface angle (e.g., by directional sensor 51). However, provided that the same surface measured rotational orientation is maintained, it may be assumed for purposes of relatively short lengths of the wellbore 33, limited in length to a selected number (e.g., one or two) of segments of drill pipe making up the drill string 35, that maintaining a selected surface measured drill string orientation will result in the toolface angle of the steerable motor 41 being similarly maintained. The foregoing relationship between the surface measured drill string orientation and the toolface angle may prove useful if the toolface measurement from directional sensor 51 is communicated to the surface using MWD telemetry techniques known in the art, which may provide one to three toolface measurements per minute at the surface. During directional drilling, each time one or more segments of drill pipe are added to the drill string 35, or it is otherwise lengthened from the top drive 27 (or kelly) to the drill bit 40, the relationship between the measurement made by the drill string orientation sensor 65 and the toolface orientation (as may be measured by directional sensor 51) may change, but the relationship may be readily reestablished for the lengthened drill string 35. Directional drilling by slide drilling as described above may continue until a desired wellbore inclination angle is obtained, such as indicated at X in FIG. 1. Thereafter, the wellbore 35 may be drilled along a substantially constant trajectory to an endpoint, e.g., as indicated by F in FIG. 1. The foregoing disclosure of maintaining the toolface angle of the steerable motor 41 by maintaining a measured drill string orientation at the surface may be performed automatically by operation of the drill string rotation controller (61 in FIG. 2) in response to command signals generated by the processor (55 in FIG. 2). The processor 55 may be programmed to maintain a selected surface measured orientation of the drill string 35 by suitable programming to respond to the sensor inputs as described with reference to FIG. 2 and particularly with respect to the measurements of torque and rotational orientation of the drill string 35 made at the surface.

In an example implementation according to the present disclosure, a torque may be measured at the surface, beginning at the kickoff point K. The measurement of this torque may be made with the drill string 35 rotating, but with the drill bit 40 not in contact with the bottom of the wellbore 33. This measured torque value, called the "off bottom rotating torque" may be used as a reference value for further operation of the top drive 27 or rotary table (not shown).

Slide drilling may begin at the kickoff point K, wherein the orientation of the steerable motor 41 (i.e., motor toolface) may be established by rotation of the drill string 35 to the desired rotary orientation. The orientation of the drill string 35 at the surface may be established by the orientation sensor 65. During slide drilling, starting at the kickoff point K as described above, substantially all the reactive torque exerted by the steerable motor 41 will be transmitted along the drill string 35 to the surface. The top drive 27 or rotary table (not shown) may be controlled (e.g., by drill string rotation controller 61 in FIG. 2) to apply torque to the drill string 35 at the surface so as to hold the steerable motor 41 at the desired toolface angle. Depending on the length of the drill string 35 and the torsional properties of the components of the drill string 35, such torque may cause a certain amount of rotation of the drill string 35 at the surface. That is, the drill string 35 may be "wound" between the surface and the steerable motor 41 as a result of the applied torque. Thus, the surface orientation of the drill string 35 will rotate until the drill string 35 is fully wound. The surface orientation of the drill string 35 as measured by the orientation sensor 65 upon full application of the holding torque (and stopping of rotation at the surface) may be communicated to the processor (55 in FIG. 2). The magnitude of torque required to maintain the drill string orientation at the surface may be referred to as the "holding torque." When measurements from the directional sensor 51 (i.e., MWD toolface sensor) are periodically detected at the surface, they may be communicated to the processor (55 in FIG. 2) to establish the then current relationship between the motor toolface angle and the surface orientation of the drill string 35. Measurements of the off-bottom rotating torque as described above may be made at selected points as the wellbore 33 is drilled.

The wellbore may be drilled along any selected trajectory, for example and without limitation, to a target subsurface formation so as to minimize risk of collision with a nearby existing wellbore, to a selected target formation requiring a particular trajectory so as to minimize risk of encountering drilling hazards, or to a maximum practical lateral extent in a specific formation having an approximately horizontal bedding plane orientation (or one having relatively low "dip" or inclination from horizontal) so as to maximize a practical length of the wellbore 33 within such formation.

It will be appreciated by those skilled in the art that as the amount of drilled wellbore having relatively high inclination increases, at a certain point substantially all the reactive torque exerted by the steerable motor 41 will be absorbed by friction between the wall of the wellbore 33 and part of the drill string 35 extending behind the steerable motor 41. At such point, substantially no reactive torque is communicated to the surface along the drill string 35. The significance of this relationship will be further described below.

In the present example, the torque applied by the top drive 27 (or rotary table) may be selectively increased and decreased above and below the holding torque by a selected amount. The increase and decrease of applied torque may be repeated during slide drilling from the kickoff point K as the trajectory of the wellbore 33 is changed.

The selected amount of torque variation may be an amount which limits change in the motor toolface from the selected direction by a selected angular amount. In one implementation, the toolface angle change limit may be 25 degrees, or in another example 10 degrees. Such amount of toolface angle change may be empirically correlated to the maximum amount by which the torque applied at the surface is increased and decreased above and below the holding torque value. It is believed that the maximum amount is related to a fractional amount of the off-bottom rotating torque. The fractional amount may be determined empirically or may be predetermined, for example 25 percent, or in another example 10 percent of the off bottom rotating torque. It may be expected that, as the off-bottom rotating torque increases during the drilling (as determined by the additional measurements made as described above), the amount of increase and decrease of the torque will become larger as the off-bottom rotating torque (measured as described above) increases.

In the event that the drill string orientation measured at the surface does not return to its original orientation with respect to the selected motor toolface orientation (i.e., toolface orientation of steerable motor 41) during any cycle of increase and decrease of torque from the holding torque, the amount of torque above or below the holding torque may be changed automatically by the controller (55 in FIG. 2) to return the surface measured drill string orientation to its original orientation. If, for example, the drill string surface orientation is counterclockwise (that is, against the ordinary direction of rotation of the drill string 35 for rotary drilling) of the original orientation, the torque increase value may be raised (or the torque decrease value lowered) so that the drill string orientation returns to its original position. If the drill string surface orientation is clockwise of the original orientation, the changes in torque increase or decrease values may be correspondingly changed to return the drill string surface orientation to its original orientation.

As described above, as the trajectory of the wellbore 33 is changed, the amount of reactive torque transmitted along the drill string 35 may become progressively smaller. At a certain point in the directional drilling process, the amount of holding torque reduced by the selected amount will become zero. At such time, the method according to the present disclosure may be ended, and a process such as described in U.S. Pat. No. 7,810,584 issued to Haci et al. may be initiated.

While the foregoing is directed to implementations of various techniques disclosed herein, other and further implementations may be devised without departing from the basic scope thereof. Although the subject matter has been described in language specific to structural features and/or methodological acts, it is to be understood that the subject matter defined in the appended claims is not limited to the specific features or acts described above. Rather, the specific features and acts described above are disclosed as example forms of implementing the claims.

What is claimed is:

1. A method for directionally drilling a wellbore, comprising:

at a selected point in the wellbore, measuring an off-bottom rotating torque applied to a drill string in the wellbore;

orienting a steerable drilling motor proximate a bottom of the drill string in a selected direction and measuring a surface rotational orientation of the drill string;

applying torque to the drill string at the surface to maintain the surface rotational orientation; and automatically increasing and decreasing the applied torque by a selected amount, the selected amount chosen to at least one of (i) maintain orientation of the steerable drilling motor within a predetermined angle range of the selected direction when reactive torque from the steerable drilling motor reaches the surface during drilling and (ii) be within a range of about 25 percent of the of the measured off-bottom rotating torque.

2. The method of claim 1 further comprising automatically adjusting at least one of the selected amount of increase and the selected amount of decrease to return the measured drill string orientation to the value measured when orienting the steerable drilling motor.

3. The method of claim 1 further comprising directionally drilling the wellbore and adjusting an amount of the applied torque such that the orientation of the drilling motor is maintained.

4. The method of claim 3 further comprising stopping the automatically increasing and decreasing the applied torque when the decreased applied torque substantially reaches zero.

5. The method of claim 1 further comprising establishing a relationship between the measured orientation of the drill string at the surface and the steerable motor toolface angle by measuring the toolface angle proximate the motor.

6. The method of claim 5 wherein the measured toolface proximate the motor is communicated to the surface.

7. The method of claim 5 further comprising at selected times repeating the establishing the relationship as the wellbore is lengthened.

8. The method of claim 1 wherein the range of the measured off-bottom rotating torque is about 10 percent.

9. A directional drilling system, comprising:

a steerable drilling motor coupled to a drill string;

means for rotating the drill string at the surface, the means for rotating comprising a rotation controller;

a torque sensor for measuring torque applied by the means for rotating;

a rotational orientation sensor for determining rotary orientation of the drill string at the surface;

a sensor proximate the steerable drilling motor for measuring a toolface angle thereof; and a processor in signal communication with the rotation controller, the torque sensor, the rotational orientation sensor and the toolface angle sensor, the processor programmed to operate the rotation controller to cause the means for rotating to apply a holding torque to maintain a drill string orientation measured at the surface while increasing and decreasing a torque applied to the drill string by a selected amount chosen to at least one of (i) maintain orientation of the steerable drilling motor within a predetermined angle range of the selected direction when reactive torque from the steerable drilling motor reaches the surface during drilling and (ii) be within a range of about 25 percent of the of the measured off-bottom rotating torque.

10. The system of claim 9 wherein the processor is programmed to automatically adjust at least one of the selected amount of increase and the selected amount of decrease to return the measured drill string orientation to the value measured when orienting the steerable drilling motor.

11. The system of claim 9 wherein the processor is programmed to automatically adjust an amount of the applied torque such that the orientation of the drilling motor is maintained while directionally drilling a wellbore.

12. The system of claim 11 wherein the processor is programmed to automatically stop increasing and decreasing the applied torque when the decreased applied torque substantially reaches zero.

13. The system of claim 9 wherein the processor is programmed to establish a relationship between the measured orientation of the drill string at the surface and the steerable motor toolface angle by measuring the toolface angle proximate the motor.

14. The system of claim 13 further comprising means for communicating the measured toolface proximate the motor to the processor.

15. The system of claim 13 wherein the processor is programmed to repeat the establishing the relationship at selected times as the wellbore is lengthened.

16. The system of claim 9 wherein the range of the measured off-bottom rotating torque is about 10 percent.

* * * * *